US006648766B1

(12) United States Patent
Cheng

(10) Patent No.: US 6,648,766 B1
(45) Date of Patent: Nov. 18, 2003

(54) COOL-WROUGHT PRESSING FORMING METHOD FOR SLOTTED HEADLESS SCREWS

(76) Inventor: Wen-Lung Cheng, 10F-2, No. 91, Ta-Shun 1st Rd, Tsow-Inn District, Kaohsiung City (TW)

( * ) Notice: Subject to any disclaimer, the term of this patent is extended or adjusted under 35 U.S.C. 154(b) by 0 days.

(21) Appl. No.: 10/176,085

(22) Filed: Jun. 21, 2002

(51) Int. Cl.[7] ..... B21H 3/02; B23G 9/00
(52) U.S. Cl. ..... 470/9; 470/8; 470/63
(58) Field of Search ..... 470/8, 9, 16, 57, 470/58, 60, 63, 131, 148, 149, 150, 151, 161, 184, 191

(56) References Cited

U.S. PATENT DOCUMENTS 1,978,372 A * 10/1934 Purtell ..... 470/8
2,813,279 A * 11/1957 Friedman ..... 470/8
2,927,332 A * 3/1960 Moore ..... 470/8
3,477,075 A * 11/1969 Putetti ..... 470/8
5,904,623 A * 5/1999 Chang ..... 470/63
6,220,805 B1 * 4/2001 Chang ..... 411/403

* cited by examiner

*Primary Examiner*—Ed Tolan
(74) *Attorney, Agent, or Firm*—Troxell Law Office PLLC

(57) ABSTRACT

A cool-wrought pressing forming method for slotted headless screws includes five steps of using five different molds and five pressing heads for processing a unit of screw material cut from linear material for forming an unfinished screw with a slot in an upper end. A clamping member is provided for clamping a screw material for moving it from a first mold in a first step to a second mold in a second step after pressed by a first pressing head and then from a second step to a third mold in a third step, and so forth. The slot of a screw is formed by pressing to make the slot neat and without any hairy sides and look very flat, enhancing production effect and lowering cost.

9 Claims, 3 Drawing Sheets

COOL-WROUGHT PRESSING FORMING METHOD FOR SLOTTED HEADLESS SCREWS

BACKGROUND OF THE INVENTION

This invention relates to a cool-wrought pressing forming method for slotted headless screws, particularly to one enhancing effectively production of tidy looking slotted headless screws and lowering their cost.

A conventional processing method for slotted headless screws includes various steps of pressing a material, forming a slot on an upper end surface and of cutting threads by a thread-forming machine. However, this kind of processing for slotted headless screws may cause hairy sides and an untidy circumference around a slot, damaged threads, etc. Moreover, cutting tools may also wear off, resulting in increased production cost and impossibility of enhancing the quality of products.

SUMMARY OF THE INVENTION

This invention has been devised to offer a cool-wrought pressing forming method for slotted headless screws, which can elevate effectively production of neat and tidy looking slotted headless screws with lowered cost.

The cool-wrought pressing forming method for slotted headless screws in the invention includes a plurality of stages, which have a first one of cutting linear material into a length of one screw material and pressing each screw material in five different molds and pressed by five different heads one by one orderly and to form an unfinished screw with a slot and then it is cut with threads by means of a thread forming machine to finish it. Then the slot of each finished screw is neat and tidy looking.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
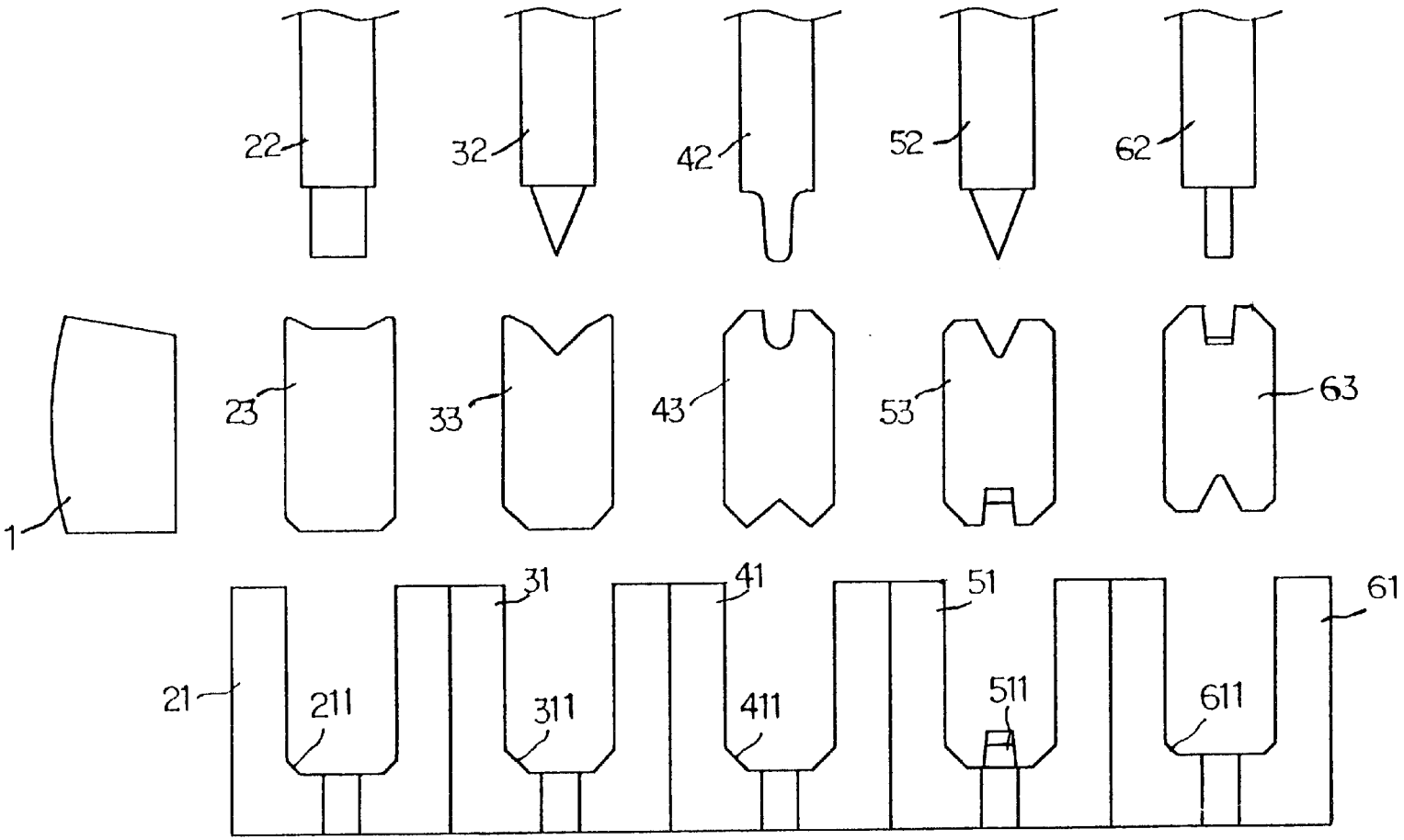
FIG. 1 is a flowing chart of a cool-wrought pressing forming method for slotted headless screws in the present invention.
Figure 2:
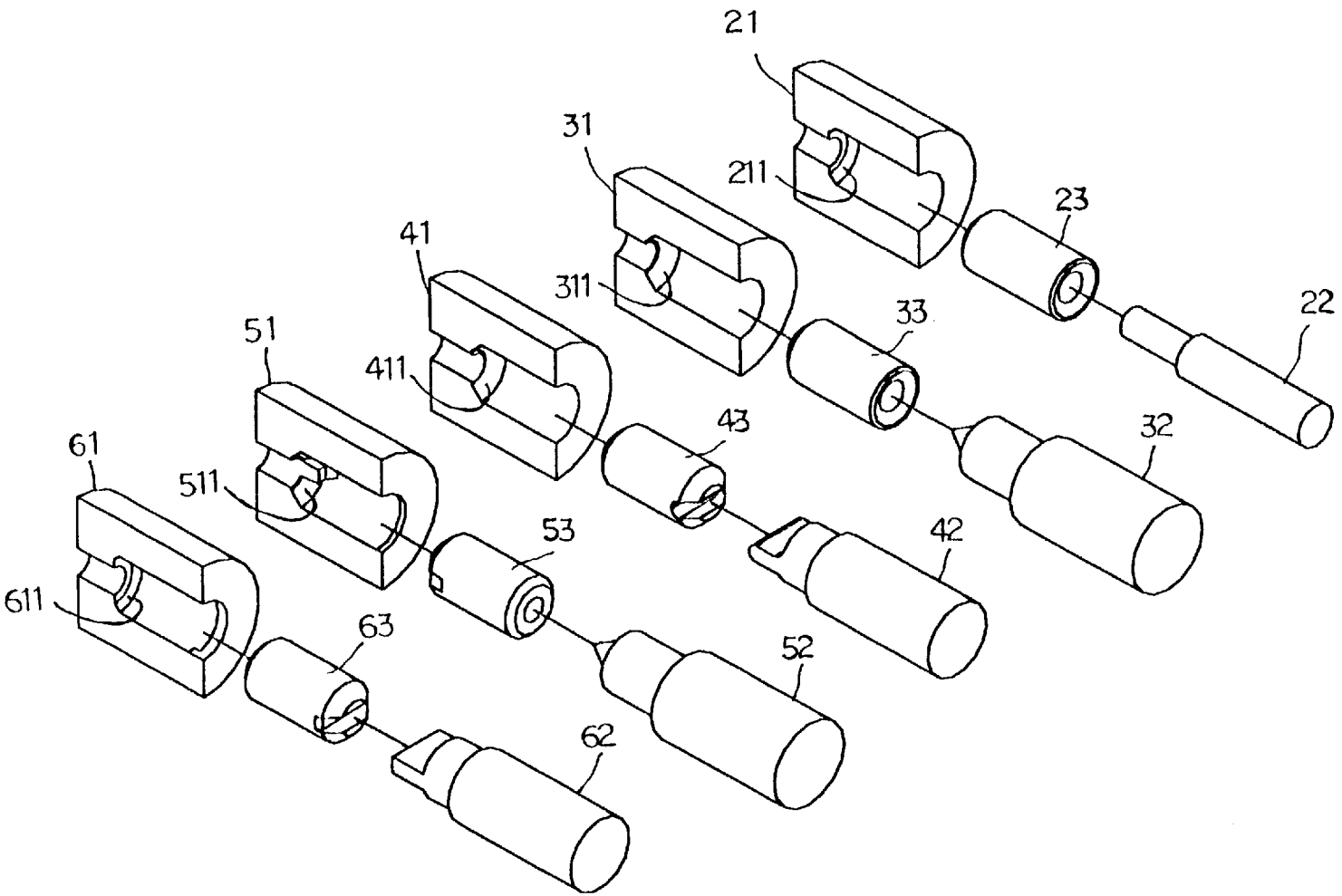
FIG. 2 is a perspective view of the pressing forming process in the present invention; and, FIG. 3 is a perspective view of clamping members respectively clamping a screw material in the present invention.

A preferred embodiment of a cool-wrought pressing forming method for slotted headless screws in the present invention, as shown in FIGS. 1 and 2, includes five steps. The first step is cutting linear material into many units of screw materials and sending one of them to a first mold 21, which has an outer cylindrical shape and an inner cylindrical hollow with an annular curved guide angle 211 formed in its bottom. Further a first pressing head 22 is provided, having the same shape and diameter as the inner cylindrical hollow of the mold 21 and a flat bottom. The pressing head 22 is pressed down on a screw material placed the inner hollow in the first mold 21, forming the screw material to become a first-stage unfinished screw 23 with an annular curved bottom guide angle corresponding to the annular guide angle 211 of the first mold 21.

A second step is to take the first-stage unfinished screw 23 out of the first mold 21 and place it in a second mold 31. The second mold 31 also has an outer cylindrical shape and an inner cylindrical hollow with an annular curved guide angle 311 in its bottom similar to the annular guide angle 211 of the first mold 21 but a little larger. And a second pressing head 32 is provided, having a conical shape, is made to press down on the first-stage unfinished screw 23 so that the first-stage unfinished screw 23 may become a second-stage unfinished screw 33 having an annular curved guide angle as that 311 of the second mold 31 and an upper V-shaped recess in an upper end surface.

A third step is to take out and invert for 180 degrees the second-stage unfinished screw 33, and then place it in a third mold 41, which also has an outer cylindrical shaped and an inner cylindrical hollow with an annular curved guide angle 411 in its bottom. Further, a third pressing head 42 is provided, having a rectangular shape to press down on the second-stage unfinished screw 33 so that the second-stage unfinished screw 33 may become a third-stage unfinished screw having the V-shaped recess end with an annular guide angle corresponding to an annular guide angle 411 of the third mold 41 and a rectangular groove 431 in an upper end. The pressing head 42 is preferably shaped to have an annular round angle in the lower end owing to a comparatively large force to be added on it in pressing the unfinished screw. But it can be made to have a straight angle in the lower end if it is needed.

A fourth step is to take out and invert for 180 degrees the third-stage unfinished screw 43, and then place it in a fourth mold 51, which is also shaped to have an outer cylindrical shaped, an inner cylindrical hollow and a rectangular projecting 511 formed in the bottom of the inner cylindrical hollow. The rectangular projection 511 has a shape fitting with the rectangular groove 431 so that the rectangular groove 431 may have a flat bottom, when a fourth pressing head 52 with a conical shape presses down on the third-stage unfinished screw 43, which becomes a fourth-stage unfinished screw 53. And the upper end of the fourth-stage unfinished screw 53 may have a more acute V-shaped recess.

A fifth step is to take out and invert again for 180 degrees the fourth-stage unfinished screw 53, and then place it in a fifth mold 61, which also has an outer cylindrical shape and an inner cylindrical hollow with a annular curved guide angle 611 in its bottom. A fifth pressing head 62 is provided, having a rectangular shape, and is made to press down on the fourth-stage unfinished screw 53 placed in the fifth mold 61. Then the fourth-stage unfinished screw 53 may become a fifth unfinished screw 63 with the rectangular groove 431 having a more vertical and flatter surface. In case there should be any hairy sides or untidy surfaces produced in the fourth step, the pressing head 62 in the fifth step may press them completely tidy and neat.

Then the fifth-stage unfinished screw 63 is formed with threads with a thread forming machine to become a finished slotted headless screw. In addition, the conical pressing head 32 used in the second step and the second mold 31 and the conical pressing head used in the fourth step and the fourth mold 51 can be replaced with pressing heads having a flat or recessed head, and molds having a flat bottom or conical recessed bottom in the inner cylindrical hollow, if needed for make headless screws with a flat or conical bottom.

Figure 3:
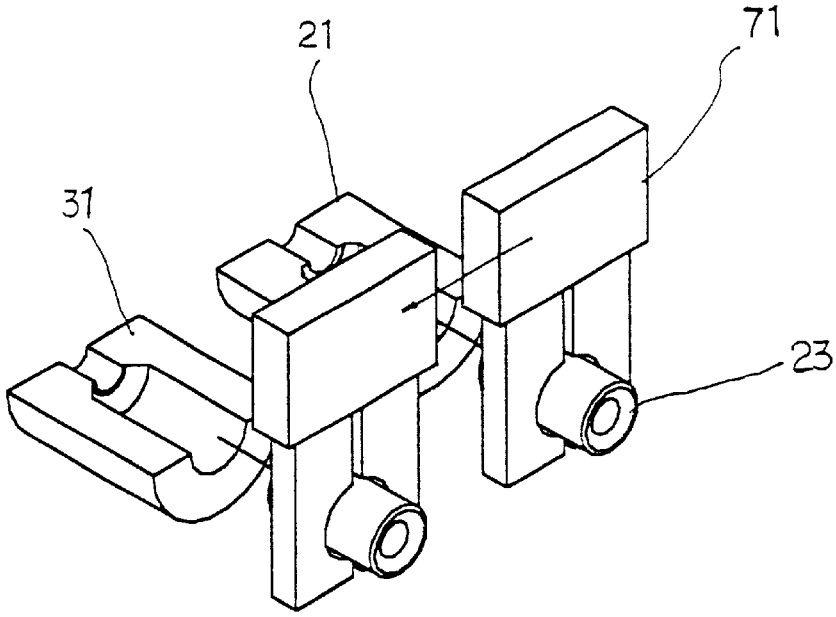
Figure 3:
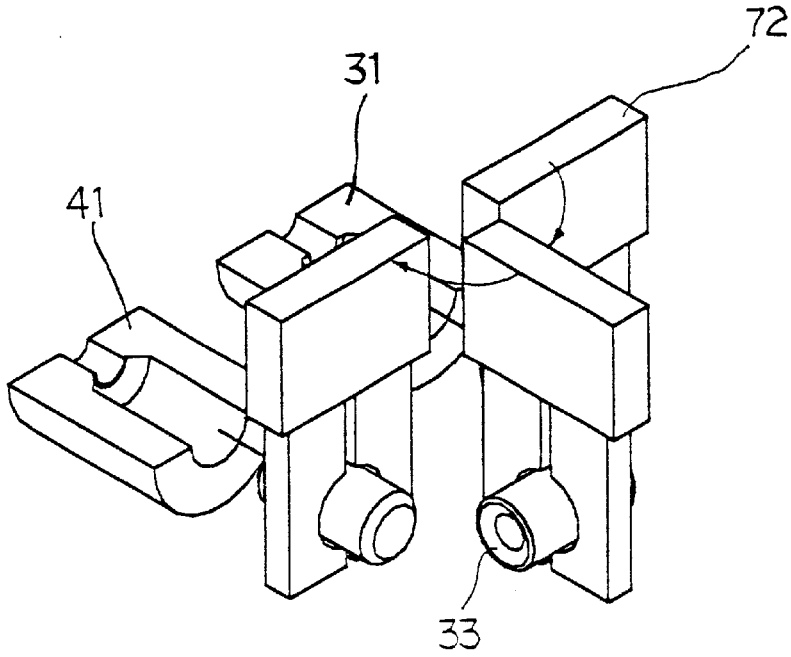

Moreover, FIG. 3 shows a clamping member 71 used in the present invention for clamping a first-stage unfinished screw 23 and sent together with the first mold 21 to the second mold 31, in order to move the first-stage unfinished screw 23 to be placed in the second mold 31. When the pressing process proceeds to the second step, the clamping member 72 clamps the second-stage unfinished screw 33 and then is rotated to let the second-stage unfinished screw 33 to invert horizontally and let the second mold 31 move the second-stage unfinished screw 33 to the third mold 41. Further, the third mold 41 has a through hole in its bottom for a bar to fit through for pushing the third-stage unfinished screw 43 finished in pressing by the third pressing head 42 out of the third mold 41. Then the third-stage unfinished screw 43 may be clamped by the clamping member 72 again for moving and rotating the third-stage unfinished screw 43 to the fourth mold. 51, and so forth As can be understood from the aforesaid description, the invention has the following advantages.

1. It uses pressing process for forming slotted headless screws so its production may be swift, and subsequently it can greatly enhance production effect.

2. It does not use any cutting tools so that no cutting machines have to be accommodated, saving wearing cost of cutting tools.

3. Slotted headless screws produced by the method according to the invention may have neat and tidy flat surface of the slot, appearing really pretty.

While the preferred embodiment has been described above, it will be recognized and understood that various modifications may be made therein and the appended claims are intended to cover all such modifications that may fall within the spirit and scope of the invention.

I claim:

1. A cool-wrought pressing forming method for slotted headless screws comprising:

a first step of cutting linear material into many units of a certain length just for one screw, each said unit screw material placed in a first mold, said first mold having an outer cylindrical shape and an inner cylindrical hollow, said inner cylindrical hollow having an annular curved guide angle in its bottom, a first pressing head having a flat end surface, said first pressing head pressing said unit material placed in said first mold to form a first-stage unfinished screw;

a second step of taking out and placing said first-stage unfinished screw in a second mold, said second mold having an outer cylindrical shape and an inner cylindrical hollow with a bottom provided with an annular curved guide angle, a second pressing head of a conical shape pressing on said first-stage unfinished screw in said second mold, said first-stage unfinished screw becoming a second-stage unfinished screw having a V-shaped recess formed in an upper end surface;

a third step of taking said second-stage unfinished screw out of said second mold, said second-stage unfinished screw inverted for 180 degrees and then placed in a third mold, said third mold having an outer cylindrical shape and an inner cylindrical hollow with a bottom provided with an annular curved guide angle, a third pressing head of a rectangular shape pressing on said second-stage unfinished screw, said second-stage unfinished screw becoming a third-stage screw having the conical bottom recess with an annular curved guide angle and a rectangular recess formed in an upper end of the inverted second-stage unfinished screw;

a fourth step of taking said third-stage unfinished screw out of said third mold and inverted for 180 degrees, said inverted third-stage unfinished screw placed in a fourth mold, said fourth mold having an outer cylindrical shape and an inner cylindrical hollow with a bottom provided with a rectangular projection extending upward, a fourth pressing head of a conical shape pressing down on said third-stage unfinished screw in said fourth mold, said third-stage unfinished screw becoming a fourth unfinished screw having a rectangular groove formed in the bottom and a V-shaped recess formed in an upper end of said inverted third-stage unfinished screw;

a fifth step of taking said fourth-stage unfinished screw out of said fourth mold, said fourth-stage unfinished screw inverted for 180 degrees and placed in a fifth mold, said fifth mold having an outer cylindrical shape and an inner cylindrical hollow with an annular curved guide angle and a through hole formed in a bottom, a fifth pressing head of a rectangular shape pressing down on said fourth-stage unfinished screw, said fourth-stage unfinished screw becoming a fifth-stage screw having a slot formed in an upper end and the V-shaped recess and the annular curved guide angle; said fifth-stage unfinished screw cut with threads by means of a thread forming machine to become a completed slotted headless screw.

2. The cool-wrought pressing forming method for slotted headless screws as claimed in claim 1, wherein said second pressing head and said second mold used in said second step are displaced with a pressing head of a flat end and a mold of an inner cylindrical hollow with a flat bottom for forming a screw having a flat lower end.

3. The cool-wrought pressing forming method for slotted headless screws as claimed in claim 1, wherein said fourth pressing head and said fourth mold of said fourth step are displaced with a pressing head of a flat bottom and a mold having an inner cylindrical hollow of a flat bottom for forming a screw with a flat lower end.

4. The cool-wrought pressing forming method for slotted headless screws as claimed in claim 1, wherein all said molds used in all of said steps are respectively provided with a through hole in the bottom for a bar to extend therethrough for pushing out a on-processing unfinished screw out of any mold used in any step.

5. The cool-wrought pressing forming method for slotted headless screws as claimed in claim 1, wherein a clamping member is further provided for clamping any of said unfinished screws used in all said steps and moving said unfinished screw in said second, said third, and said fourth step to the subsequent step.

6. The cool-wrought pressing forming method for slotted headless screws as claimed in claim 1, wherein said clamping member moves directly said unfinished screw from one of said molds to a next mold.

7. The cool-wrought pressing forming method for slotted headless screws as claimed in claim 1, wherein said clamping member moves said finished screw from one of said molds to a next mold by means of rotating.

8. The cool-wrought pressing forming method for slotted headless screws as claimed in claim 1, wherein said third pressing head is formed in a semicircular shape instead of the rectangular shape.

9. The cool-wrought pressing forming method for slotted headless screws as claimed in claim 1, wherein said third pressing head is shaped of a straight angle instead of a rectangular shape.

* * * * *